US005406928A

United States Patent [19]

Panara et al.

[11] Patent Number: 5,406,928

[45] Date of Patent: Apr. 18, 1995

[54] APPARATUS FOR LAUNCHING MOVABLE DISCS OR TARGETS

[75] Inventors: Paul Panara, Cagnes Sur Mer; Jean-Michel Laporte, Biot, both of France

[73] Assignee: Laporte, Antibes, France

[21] Appl. No.: 125,734

[22] Filed: Sep. 24, 1993

[30] Foreign Application Priority Data

Oct. 7, 1992 [FR] France ..... 92 12267
Sep. 2, 1993 [FR] France ..... 93 10639

[51] Int. Cl.[6] ..... F41J 9/18
[52] U.S. Cl. ..... 124/8; 124/47
[58] Field of Search ..... 124/6–9, 124/16, 46, 47

[56] References Cited

U.S. PATENT DOCUMENTS 2,928,383 3/1960 Ohlson ..... 124/8
2,989,045 6/1961 Hodge et al. .
3,088,452 5/1963 Foster .
3,304,928 2/1967 Darrell ..... 124/47
3,923,033 12/1975 Laporte et al. ..... 124/8
4,706,641 11/1987 Cote et al. ..... 124/8
5,036,828 8/1991 Heffer ..... 124/47

FOREIGN PATENT DOCUMENTS 677082 12/1963 Canada ..... 124/8
2114069 6/1972 France .
2419500 10/1979 France .
6800716 7/1968 Netherlands ..... 124/8
2223415 4/1990 United Kingdom .

*Primary Examiner*—Randolph A. Reese
*Assistant Examiner*—John A. Ricci
*Attorney, Agent, or Firm*—Young & Thompson

[57] ABSTRACT

Apparatus for launching targets for trap shooting whose speed and distance of projection are variable, of the type using a rotatable drum (1)into which are loaded movable targets (2). The movable targets (2) are superposed on each other in columns (3), maintained by tubes or vertical rollers, disposed between a recessed upper holding plate or having radial arms for the storage of movable targets and a lower recessed holding plate (4) for each column (3) of targets (2), or having radial arms between each column (3) of targets (2). The lower plate (4) is above and parallel to a fixed base plate which comprises a single recess (5) so as to permit the passage of movable targets (2) which are received on a launching plate (6) disposed before an ejection arm (7). One or several motors ensures the rotation of the drum (1) and the movement of the ejection arm (7). The launching plate (6)is comprised by a fixed launching ramp (9) and a movable launching ramp (8) articulated about a substantially transverse pivotal axis (10). The upper surfaces of the ramps (9, 8) are at the same height below and parallel to the path of the assembly of the ejection arm (7).

14 Claims, 8 Drawing Sheets

Section NN

Section MM

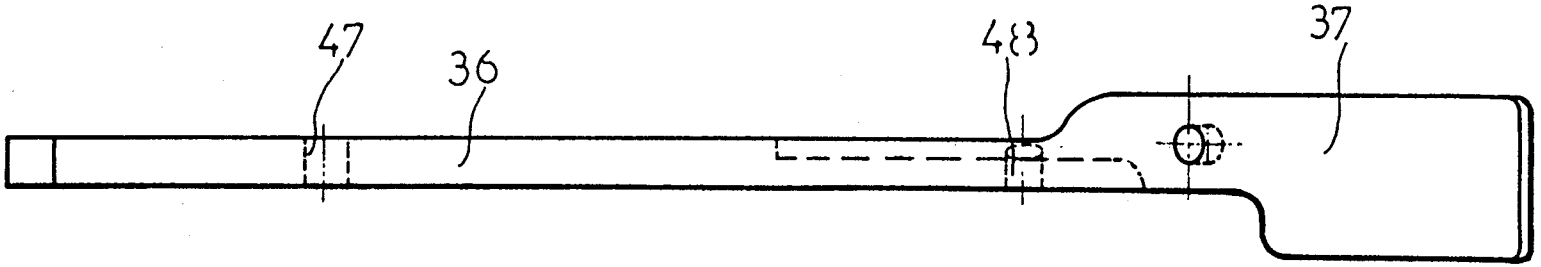
Fig-16
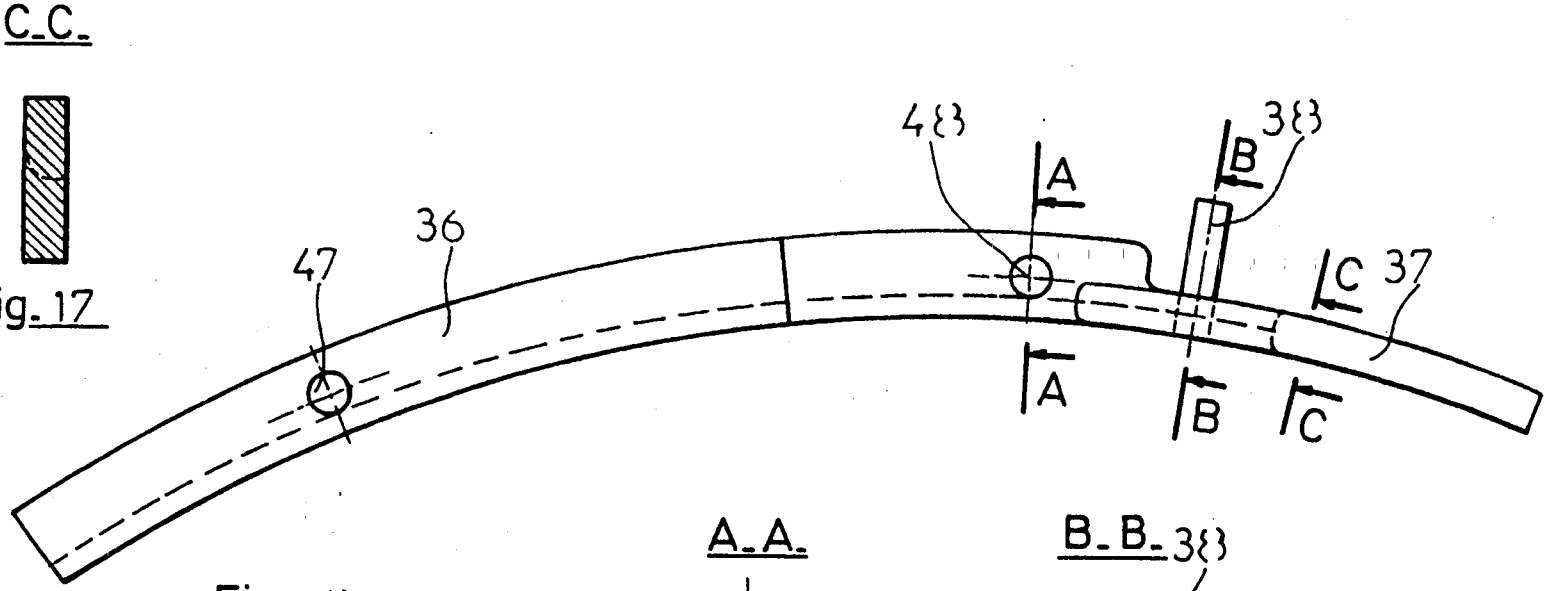
Fig-18
C-C-
Fig-17
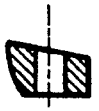
A-A-
Fig-19
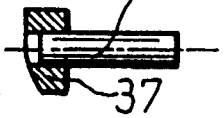
B-B-
Fig-20

APPARATUS FOR LAUNCHING MOVABLE DISCS OR TARGETS

FIELD OF THE INVENTION

The invention has for its object an apparatus for the launching of movable discs or targets for trap shooting.

More precisely, the object of the invention is to provide an improvement in the supply of movable discs or targets.

This improvement relates to a device for distribution of said discs or targets, such that the storage space of these latter will be as limited as possible.

BACKGROUND OF THE INVENTION

The state of the art can be defined by the following documents:

FR-A-2,445,506 relates to a loader which comprises a transfer member situated in the plane of an intermediate reception stage and subjecting each target to linear displacement to directly above the throwing arm on the one hand, and guide means carried by the arm, on the other hand.

FR-A-2,419,500 relates to a loader which comprises a plate, a turret rotatably mounted on the plate and comprised by a magazine, a device for distribution with rollers mounted on the plate, a transfer assembly is suspended between the plate and the launching arm and a device for driving in synchronism the turret and the movable member of the transfer assembly.

FR-A-2,308,080 relates to an installation which comprises a target station and a trap shooting station, a transverse slideway perpendicular to the direction of shooting, a target carriage movable along the slideway between two end positions, and a transverse drive device to displace the carriage in both directions on the slideway.

Between the stations, is disposed a target transport system which is connected to one of the ends of the slideway, and the carriage can pass from the slideway to the system and inversely. The system comprises a longitudinal drive device for the displacement of the carriage in both directions between the stations.

FR-A-2,266,139 relates to a rollerway constituted by a profile whose web is vertical, carried by posts whose feet are secured to a profile whose web is disposed horizontally on the ground.

The same profile is used, a first time vertically to support the rolling rails and a second time to maintain the feet of the posts. The height of the vertical profile is adjustable. No screw or nut is necessary for mounting. Usable to displace movable targets, for retrieval of targets, but not limited thereto.

Finally, FR-A-2,114,069 relates to a projector for launching targets, comprising a magazine, a supply plate, a launching arm, a spring and means actuated by a motor to displace the plate and to cause the arm to turn while stretching the spring, the movement of the supply plate is controlled positively by means providing a cam on the external surface of a cylindrical rotatably member driven by the motor, said member comprising a drive finger which coacts with the launching arm to cause the latter to turn during the loading phase and the launching arm being mounted so as to turn freely relative to the cylindrical member in the course of the launching phase.

All these launching devices have devices for storing movable targets; these are generally stacks of said targets on each other.

These apparatus also have devices for receiving targets which are to be launched.

Among these two types of devices, the storage on the one hand and reception on the other hand, there exists a space through which the targets fall by gravity alone.

However, certain targets which are more fragile than others, because of their design or problems in production, will not withstand this drop through the air, and break, which gives rise to numerous problems.

As the prior art devices fail to solve the problems enumerated above because the use of gravity to cause the targets to fall is always used in the manner described for example, there have been proposed devices for transferring targets which have linear displacements.

SUMMARY OF THE INVENTION

The essential object of the present invention is to provide an improvement which still uses gravity, but with no risk of damage to the displaced targets.

To this end, the launching apparatus for targets for trap shooting whose speed and projecting distance are variable, is of the type using a rotatable drum into which are loaded movable targets; the movable targets are superposed on each other in columns, maintained by tubes or vertical rollers, displaced between an upper recessed retention plate or having radial arms for the storage of movable targets and a lower recessed retention plate for each column of targets, or having radial arms between each column of targets; said lower plate being in a position which is above and parallel relative to a fixed base plate which comprises a single recess so as to permit the passage of movable targets which are received on a launching plate disposed in front of an ejection arm, one or several motors ensuring the rotation of the drum and the movement of the ejection arm, characterized by the fact that said launching plate is comprised by a movable launching ramp articulated about a transverse pivotal axis.

The target launching apparatus is moreover characterized by the fact that the launching plate is comprised by a fixed launching ramp whose upper surfaces are at the same height below and parallel to the path of the assembly of the ejection arm and the movable and articulated launching ramp.

The apparatus is further characterized by the fact that the transverse pivotal axis is directed substantially in the direction of the axis of rotation of the ejection arm, such that the movable and articulated launching ramp pivots between two end positions, a position pivoted at an angle $\alpha$ in which one of the two ends of said movable launching ramp is facing and at the height of the recess provided in the base plate so as to receive at least one target from the rotatable drum, said target being adapted to be launched, and a launching position in which the movable launching ramp is at a height less than but parallel to the path of the assembly of the ejection arm.

The apparatus is also characterized by the fact that the movable and articulated launching ramp has in its lower portion a longitudinal swinging axis, said axis being substantially parallel to the tangent to the trajectory of the ejection arm at the level of the movable launching ramp, such that said movable and articulated launching ramp swings between two end positions, a launching position in which the movable launching ramp is at a height less than and parallel to the path of the ejection arm assembly, and a swung position in which the ramp is swung at an angle $\beta$ about the swinging axis.

Another advantage of the use of the movable ramp is to facilitate the ejection of broken pieces of targets which, despite all precautions taken, will be present.

The movable articulated ramp coacts with a guide element which serves as a slideway.

This slideway is itself adjustable as to its arc and its radius.

It is itself arcuate or in the shape of a comma.

This slideway is itself secured to the launching plate.

In the case in which the targets used always have the same shape such as: diameter, thickness, the slideway is adjustable to a height suitable to coact with the edge of the target.

In practice, the targets will have several sources of manufacture, and various dimensions.

Moreover, it can be of interest to the trap shooter to launch small size targets such as "minis" whose dimensions are 90 mm in diameter, 24 mm thick, for a weight of 70 g, or "bees" whose dimensions are as follows: 60 mm diameter, 20 mm thickness and a weight of 36 g.

There can also be launched two targets at the same time which do not have the same sizes.

The slideway should therefore perform its guide function no matter what the size of the targets and no matter what the angle of the articulated movable ramp.

The invention overcomes this problem.

According to another embodiment, the guide slideway is formed of two slideways, a fixed slideway and an articulated slideway.

The fixed slideway is parallel to the plane of the launching plate.

The articulated slideway remains parallel to the plane of the movable launching ramp.

The articulated slideway is in prolongation of the fixed slideway but it is articulated about a pivotal axis, its end in contact with the movable articulated launching ramp ensuring the simultaneous movement with said ramp.

The contact between the articulated slideway and the articulated movable ramp is ensured by holding fingers disposed on opposite sides of each surface of said ramp.

The articulated movable ramp is provided with several openings about its periphery which permit the replacement of an abutment for the targets. Said abutment is a recurved member such as a hook whose one part is fixed to the frame of the apparatus and whose other part can be disposed in one of the openings of the articulated movable ramp selected as a function of the size of the targets chosen.

This abutment in the form of a hook is disposed below the movable ramp, its end serving as an abutment per se passing through the selected opening of the articulated movable ramp.

The return of the hook has a height sufficient to be able to leave free the passage for the pivoting of the articulated movable ramp.

The fixed holding slideway is maintained by securements such as screws, rivets, axles, etc.

BRIEF DESCRIPTION OF THE DRAWINGS

The accompanying drawings are given by way of indicative but non-limiting examples. They will permit easy comprehension of the invention.

FIG. 16 is a side view of the holding slideways (fixed and articulated) showing their securement and articulation points.

FIG. 17 is a cross-sectional view on the axis C—C shown in FIG. 18.

FIG. 18 is a plan view of the holding slideways (fixed and articulated) showing their point of securement and of articulation.

FIG. 19 is a cross-sectional view on the axis A—A shown in FIG. 18.

FIG. 20 is a cross-sectional view on the axis B—B shown in FIG. 18.

Finally.

DETAILED DESCRIPTION OF THE INVENTION

Figure 1:
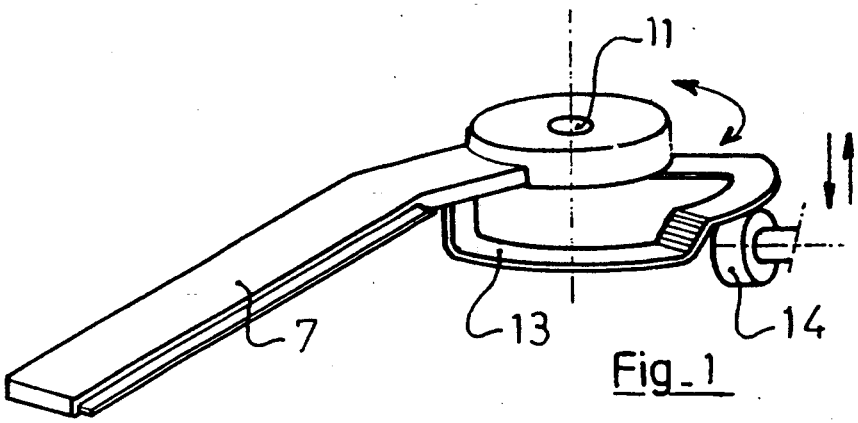
FIG. 1 shows the ejection arm and the control mechanism of the pivoting axle.

According to FIG. 1, an important element of the apparatus for launching movable discs or targets 2 is shown.

It comprises an ejection arm 7, which is secured to its axle of rotation 11.

A circular arrow shows moreover the movement of rotation which said arm 7 undergoes about its axle 11.

Situated below the arm 7 and of the axle 11 but still fixed thereto, a pivoting cam 13 permits giving rise to a pivoting movement, such as shown by the two arrows in opposite directions, on a roller 14 fixed to the movable and articulated launching ramp, which is not shown here.

Figure 2:
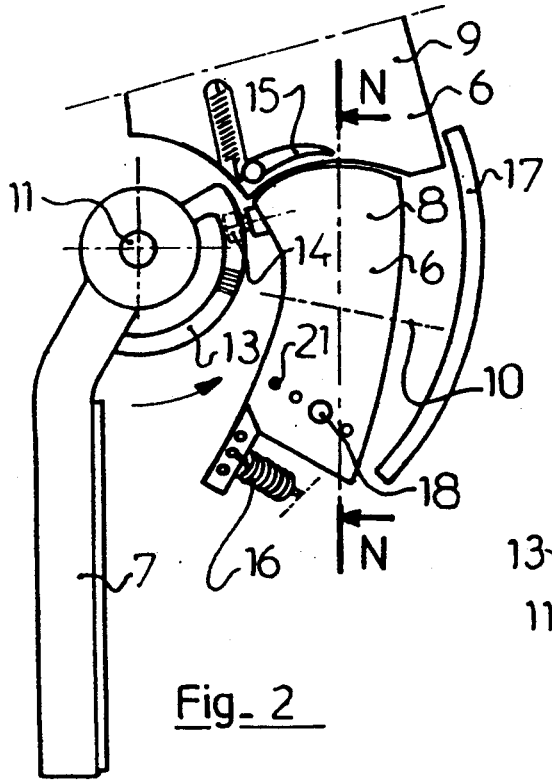
FIG. 2 shows a view from above of the movable and articulated launching ramp when the ejection arm is upstream of said ramp relative to the path of launching of the targets, the ramp being in reception position for a target.

FIG. 2 permits better understanding of the location of the element of FIG. 1 relative to the launching plate 6.

The launching plate 6 is formed of two launching ramps, one which is movable and articulated 8 and the other of which is fixed 9.

The roller 14 is fixed to the movable ramp 8 by its axle, but it is shown in phantom line because the pivoting cam 13 is disposed above the latter.

Also shown in broken line, the pivotal axis 10 of the movable and articulated launching ramp 8 is located in a medial position.

Figure 4:
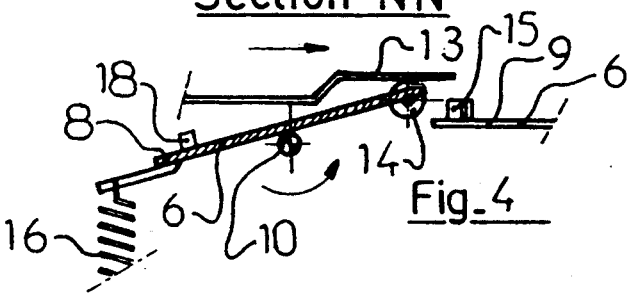
FIG. 4 is a cross section on N—N of FIG. 2.
Figure 5:
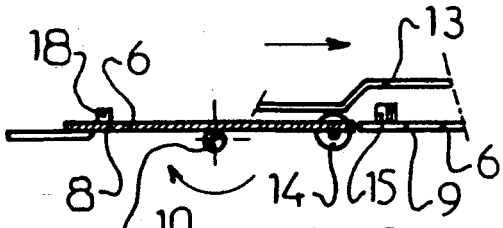
FIG. 5 is a cross section on M—M of FIG. 3.

The functions of the different members will be more specifically developed by the cross sections of FIGS. 4 and 5.

In this figure, the ejection arm 7 is in cocked position and four elements are present to permit good operation of this launching apparatus.

There is a holding finger 15, a spring 16, a slideway 17 and the abutment 18.

This abutment 18 is adjustable, to several positions that it can occupy according to the different small holes which are located beside this abutment 18.

This is due to the fact that in practice, there exist principally two types of discs or clay pigeons: the French or European disc, which has a diameter of 110 mm, and the American disc, which has a diameter of 107.5 mm. This difference in diameter gives rise to problems in the use of the same launcher.

Figure 3:
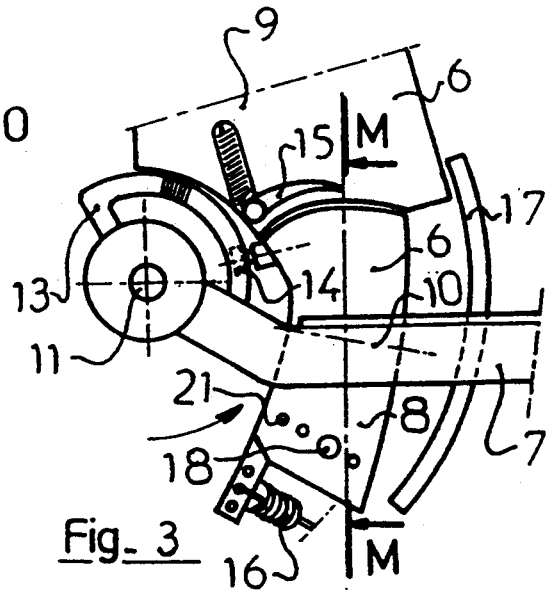
FIG. 3 shows a view from above of the movable and articulated launching ramp when the ejection arm is above said ramp in a position just before ejection of the target.

According to FIG. 3, the ejection arm 7 has undergone a rotation of about 90°, about its axle of rotation 11 and has come to occupy the position which is its own.

FIGS. 4 and 5 permit better understanding of what has been described above.

In FIG. 4, the roller 14 is in contact with the highest portion of the figures of the cam 13.

There is thus pivoting of the assembly of the movable launching ramp 8 about its axis 10 under the influence of spring 16.

The fixed launching ramp 9 is always parallel to the cam 13, which gives rise to an asymmetry of the launching plate 6, which is not uniformly flat.

FIG. 5 is very different.

As FIG. 3 shows, only the ejection arm 7 has been displaced and as a result all of the elements which are secured to said arm 7.

Such is the case with cam 13, which has swung, and of which the lowest part in the figures is now in contact with the roller 14, which permits the movable and articulated launching ramp 8 to pivot about its axis 10 under the force exerted by the spring 16, and thus to come into a position in prolongation of the fixed launching ramp 9.

The launching plate 6 is uniformly flat, while the ejection arm 7 is in position to launch a target.

The apparatus for launching targets is therefore characterized by the fact that the movable launching ramp 8 has, in its downstream portion relative to the direction of launching targets 2 and in its lower portion, a roller 14 which coacts with the cam 13 secured to the ejection arm 7, and in its upstream portion relative to the direction of launching targets 2, a spring 16; such that when the roller 14 is in contact with the portion of the cam 13 spaced farthest from the pivotal axis 10, the spring 16 brings said movable ramp 8 into pivoted position, whereas when the roller 14 is in contact with the portion of the cam 13 the nearest to pivotal axis 10, said cam 13 causes the movable ramp 8 to pivot about the pivoting axis 10, and brings it into launching position, which is to say that the upper surface of said movable ramp 8 is at the same level of height as the upper surface of the fixed launching ramp 9 which is located downstream of the movable ramp 8 relative to the direction of launching the targets.

Figure 6:
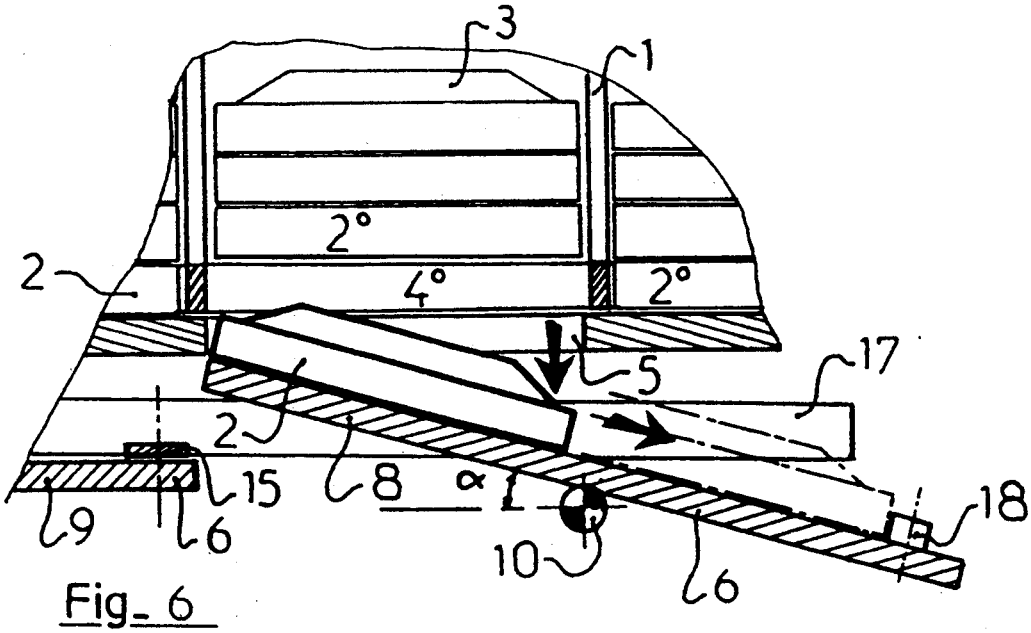
FIG. 6 is a cross section at the level of the movable and articulated launching ramp and of the lower portion of the rotatable drum, said ramp being pivoted about its pivoting axis so as to accommodate a target as well as the movement of this target.

FIG. 6 shows the use which is made of the inclination of the movable ramp 8 by the ensemble of the spring 16 and the cam 13, not shown here.

The launching plate 6 is therefore constituted by the fixed ramp 9 which is parallel to the lower plate 4 of the rotatable drum 1, but also by the movable ramp 8 whose downstream end comes into position at the height of and facing the recess 5 of the launching plate 4.

Said plate 4 supports columns 3 of movable targets 2 parallel to each other.

In this position, the next-to-last target 2 is maintained in the rotatable drum 1, while the last target 2, by gravity, falls on the downstream end of the movable ramp 8 from a very low height, without any risk of breaking.

Once the downstream portion of said movable ramp 8 is in its upper position, the target 2, still by gravity, slides into contact with the abutment 18, whose position has been adjusted as a function of the diameter of the target 2.

Figure 7:
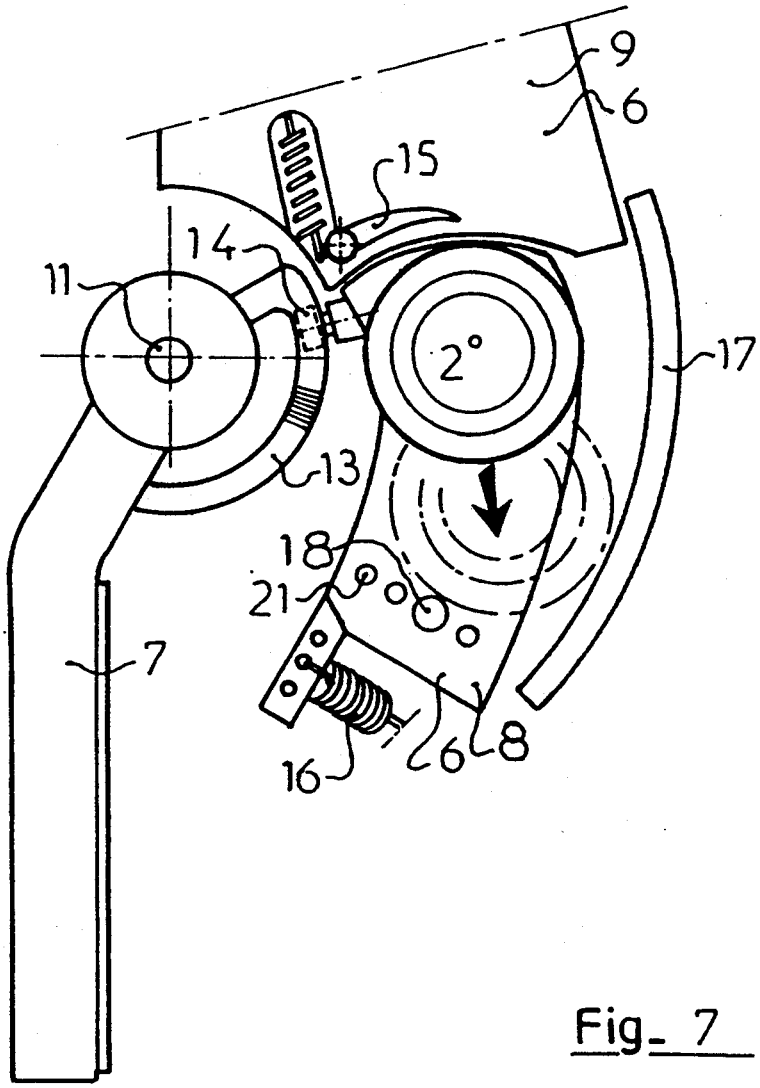
FIG. 7 is a view from above of the ramp according to FIG. 6.

FIG. 7 shows the same phenomenon, from above, which is to say without the rotatable drum 1.

The target 2 slides on the movable ramp 8 up to the abutment 18.

So that this target 2 will be properly positioned, the slideway 17 orients the target 2 such that it does not leave the ramp 8 and wedges it with the help of abutment 18.

The movable and articulated launching ramp 8 has, in its upstream portion, different holes 21 which permit the securement of at least one abutment 18 adjustably in position.

Figure 8:
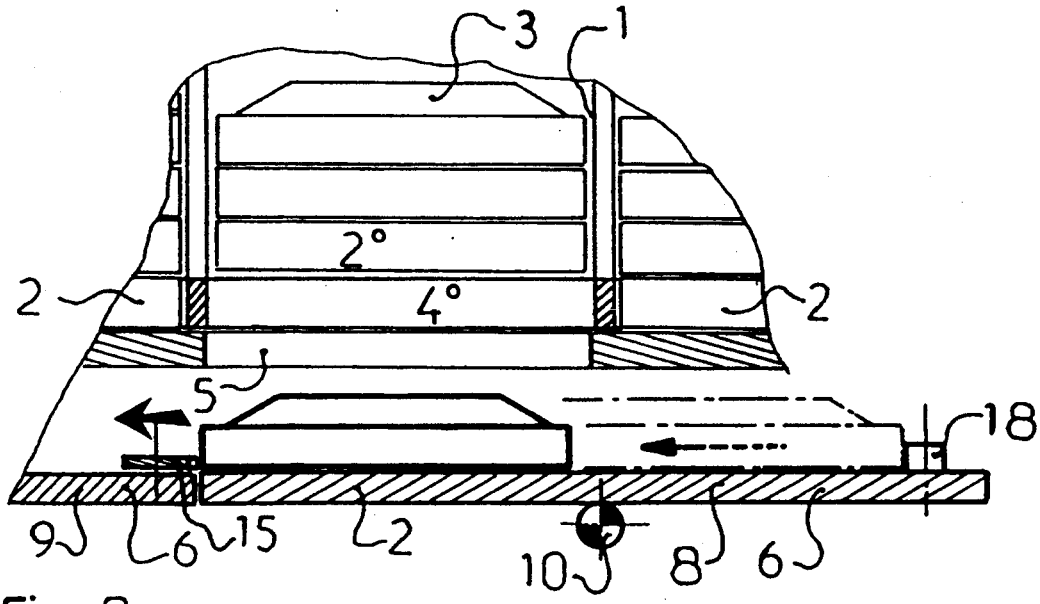
FIG. 8 is a cross section through the movable and articulated launching ramp and through the lower portion of the rotatable drum, said ramp being in launching position of the target whose movement is presented.

FIG. 8 shows the phase following the one that has been described in the two preceding figures.

The movable launching ramp 8, under the influence of the displacement of the ejection arm 7 and of the cam 13 about their axle of rotation 11, is disposed parallel to the lower plate 4, namely at the level of the fixed ramp 9.

On the other hand, the target 2 is then displaced downstream of the movable ramp 8, so as to come into contact with the holding finger 15.

The launching plate 6 has a holding finger 15 for the targets 2 which is movable in rotation relative to its axis, and can return to its initial position by means of a spring.

Figure 9:
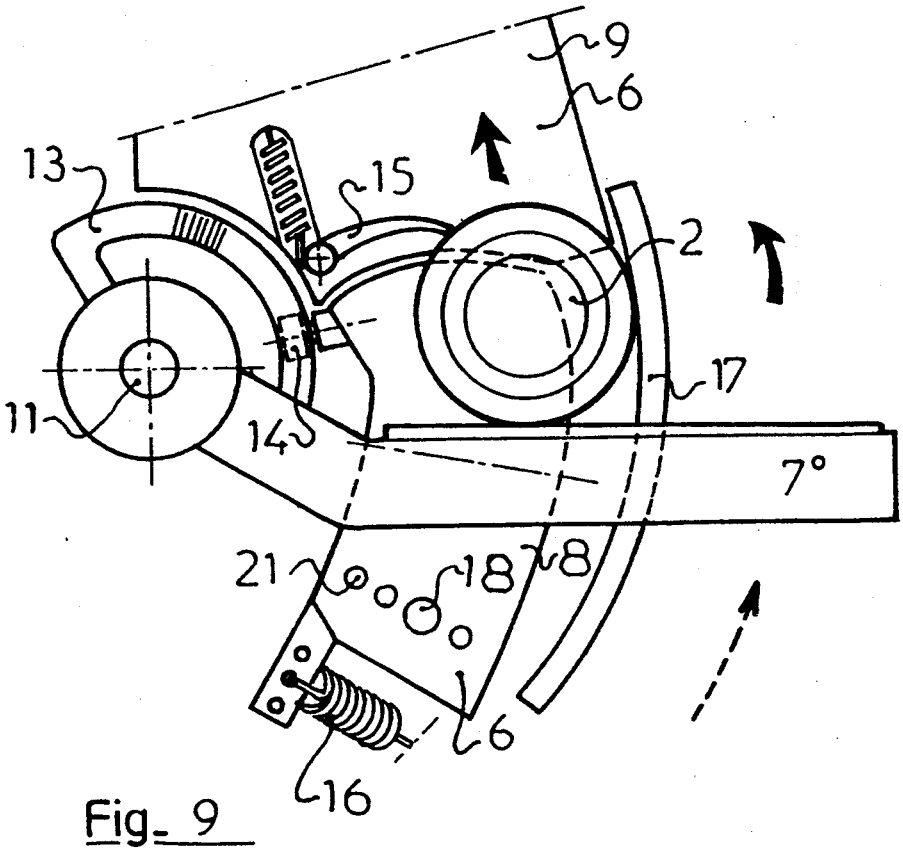
FIG. 9 is a view from above of the ramp according to FIG. 8.

According to FIG. 9, the target 2, just before being launched, is maintained in position on the launching plate 6, by the ejection arm 7 which can pass above the abutment 18, by the holding finger 15, and finally by the guide element 17, whose respective heights are less than the spacing which exists between the upper surface of the launching plate 6 and the path of the ejection arm.

The role of the holding finger 15 is to ensure good contact between the target 2 and the ejection arm 7 just before the launch itself.

This permits limiting breakage to a minimum.

Figure 11:
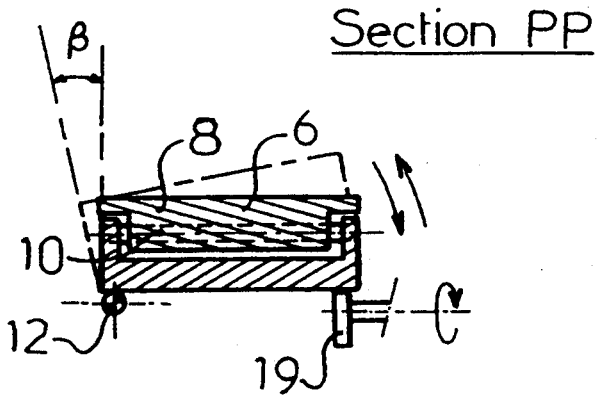
FIG. 11 is a cross section on P—P of FIG. 10, of the movable and articulated launching ramp comprising two axles, one for pivoting, the other for swinging.
Figure 10:
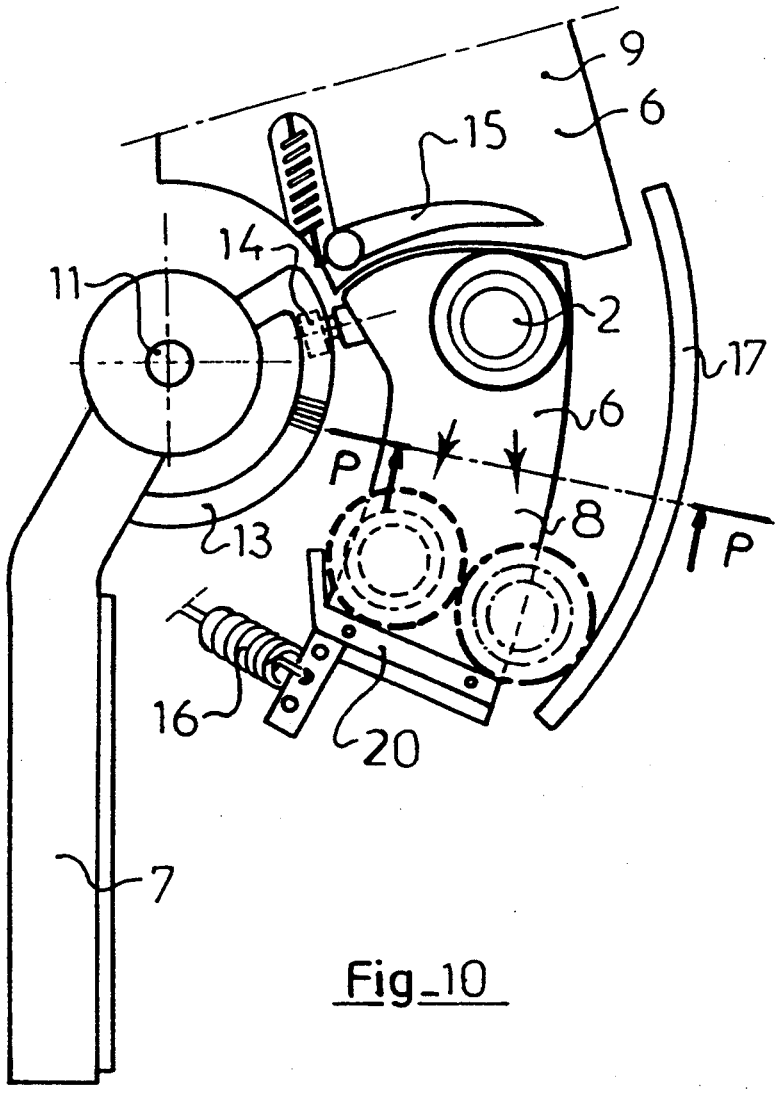
FIG. 10 is a view from above of the movable and articulated launching ramp in a position for receiving two targets as well as the movement of these targets.
Figure 12:
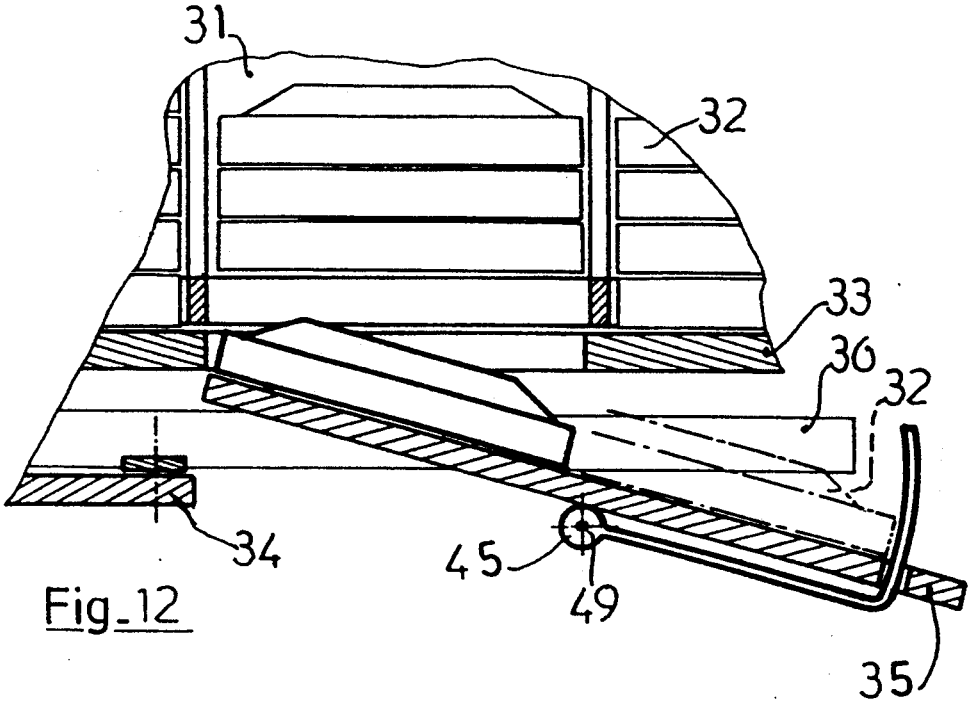
FIG. 12 is a partial cross-sectional view of the supply drum for targets, of the launching plate, of the movable articulated ramp of the holding abutment of the targets on said ramp.
Figure 13:
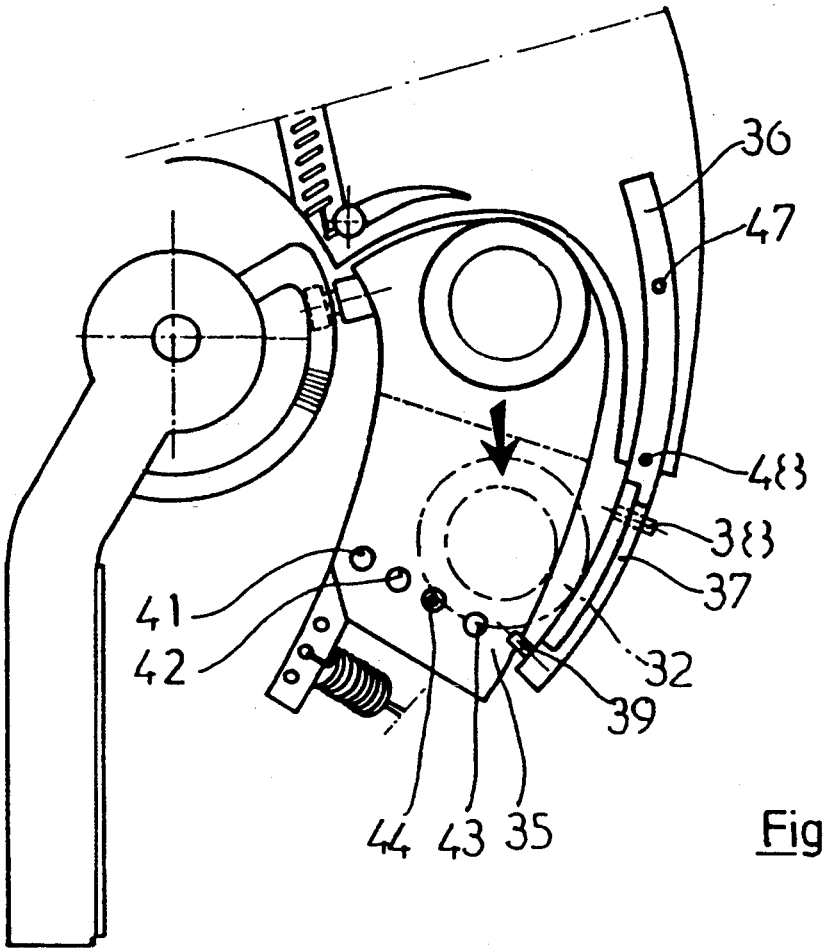
FIG. 13 is a plan view showing the launching arm, the launching plate, the fixed guidance slideway and the articulated guidance slideway.
Figure 14:
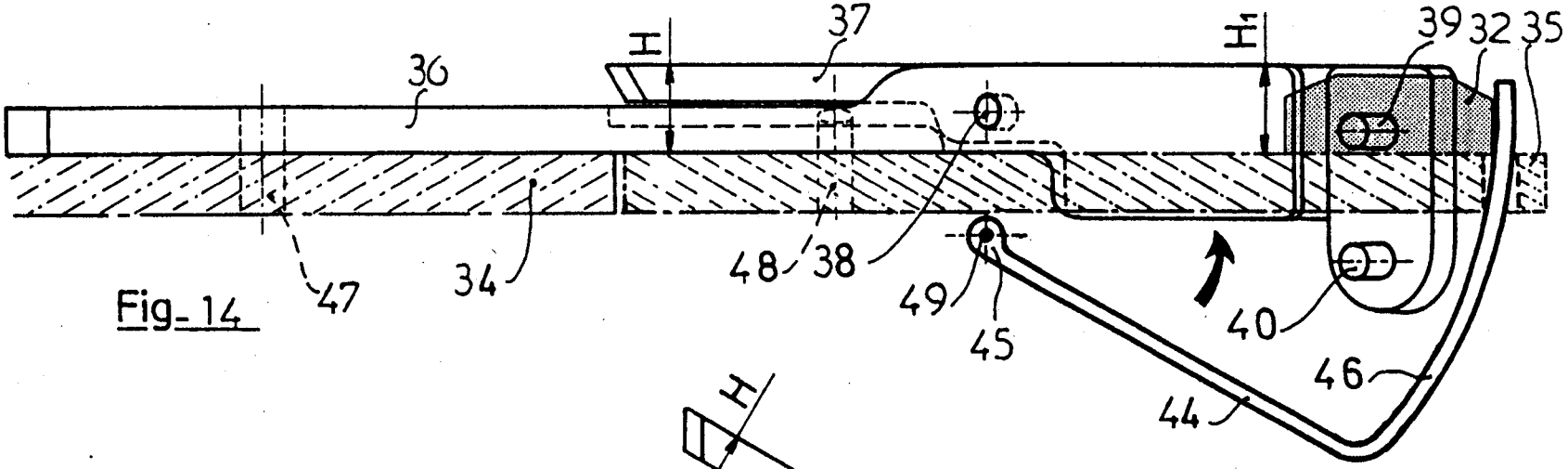
FIG. 14 is a longitudinal cross-sectional view of the launching plate and of the articulated movable ramp, in coplanar position, of the holding slideways and of the abutment.
Figure 15:
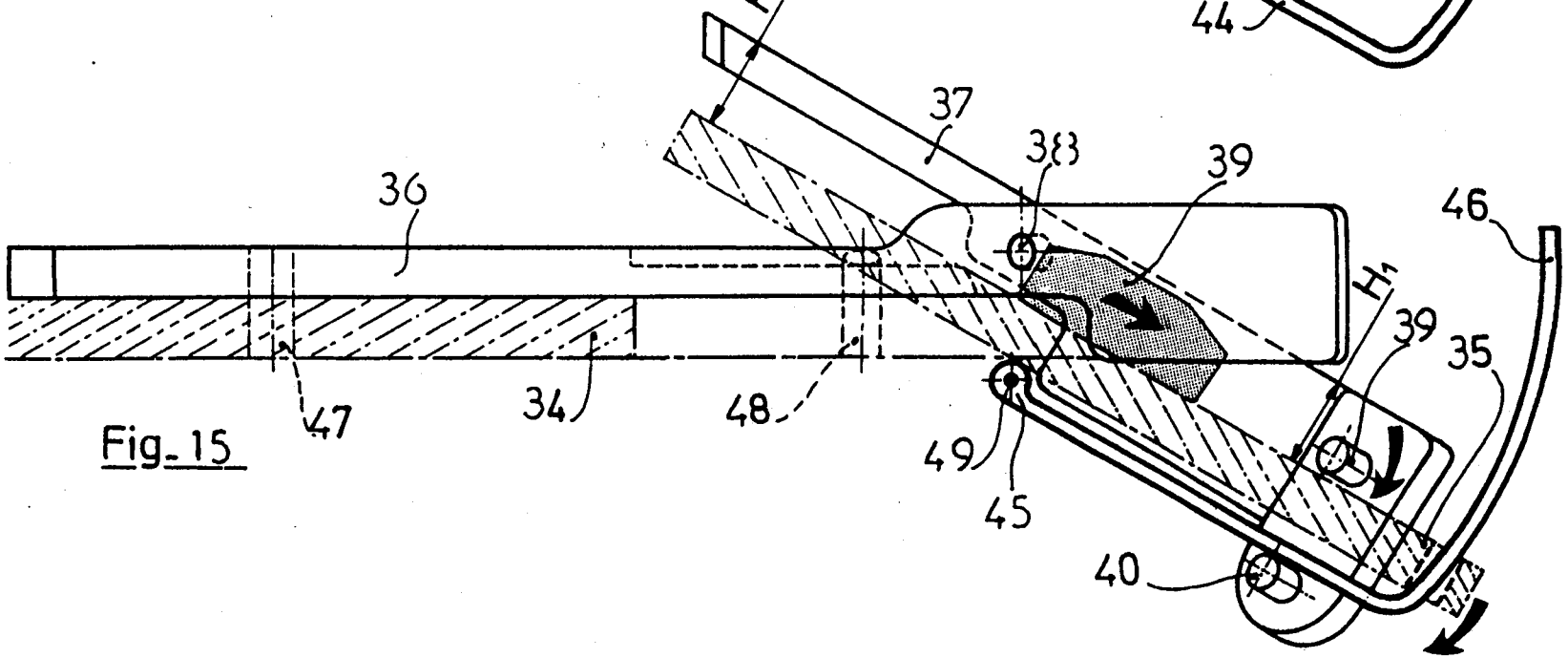
FIG. 15 is a view as in FIG. 14, but in which the movable articulated ramp is inclined.
Figure 21:
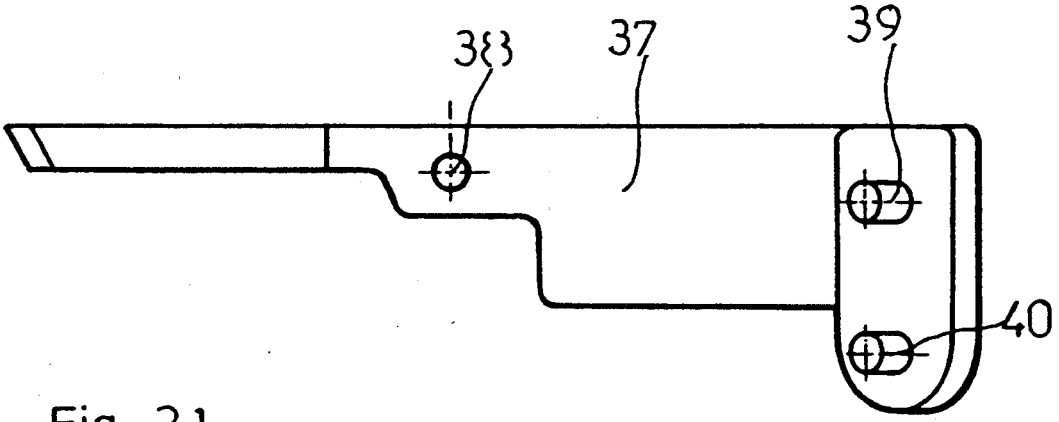
FIG. 21 is a side view of the holding slideway which is articulated.
Figure 22:
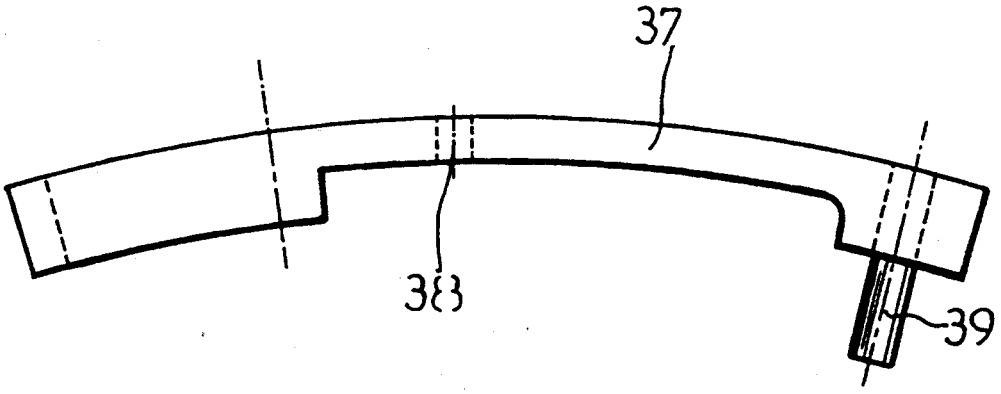
FIG. 22 is a view of the slideway according to FIG. 21 but from above.

In FIGS. 10 and 11, the apparatus for launching the targets 2 is usable for launchers comprising each two movable targets 2.

To arrive at this result, and according to FIG. 11, another axis, called swinging axis 12, permits, thanks to a camroller 19, swinging all of the movable ramp 8 toward the interior of the apparatus, which is to say in the direction of the axis of rotation I 1 of the ejection arm 7.

In other words, the operation of the pivoting axis 10 is always the same, except that before launching, this movement is effected twice.

Inserted between these two movements, the swinging movement permits the first target 2, received on the movable ramp 8, to be offset toward the axis of rotation 11 and thus not to hinder the arrival of the second target 2 beside the first target 2 already in place.

Then alone, the ejection arm 7 which has been disengaged from the cam 13, comes into contact with the two targets and causes them to slide to the holding finger 15.

So that all this may happen, it is preferable to use, instead of the abutment, an abutment element 20 which uses different points of securement of the adjustable abutment.

The abutment element has a shape such that it is impossible for the first target 2 which is subjected to lateral swinging to fall on the ground; thus, said abutment element 20 is of L shape.

The use of the abutment element 20, for launching a single target 2, is of course possible.

In the same way, to position two targets 2, one beside the other, the slideway 17 is adjustable as to arc and radius relative to the axle of rotation 11 of the ejection arm 7; this slideway 17 is installed laterally of the external side of the movable launching ramp 8.

Finally, to facilitate further the displacement of the targets 2 on the movable ramp 8, the adjustable slideway 17 is arcuate.

The target launching apparatus is of the type comprised of a rotatable drum 31 for automatic supply of targets 32, the movable targets 32 are disposed in columns maintained by vertical rollers between an upper plate and a lower plate 33, known means ensure the supply of targets 32 to the launching plate 34 by a movable launching ramp 35 articulated on an axis of articulation 49, said movable launching ramp 35 is provided laterally of the external side of an arcuate slideway 36 adjustable as to arc and as to radius relative to the axis of rotation of the ejection arm.

The guidance slideway is provided by two slideways, a fixed slideway 36 and an articulated slideway 37.

The fixed slideway 36 is parallel to the plane of the launching plate 34.

The articulated slideway 37 remains parallel to the plane of the movable launching ramp.

The articulated slideway 37 prolongs the fixed slideway 36 but it is articulated about a pivotal axis 38, its end in contact with the movable articulated launching ramp 35 ensures simultaneous movement with said ramp.

The contact of the articulated slideway 37 and of the articulated movable ramp 35 is ensured by holding fingers 39, 40 disposed on opposite sides of each surface of said ramp.

The articulated movable ramp 35 is provided with several openings 41, 42, 43 at its periphery which permit the replacement of an abutment 44 for the targets 32. Said abutment 44 is a recurved member such as a hook whose one portion 45 is secured at the level of the axis of articulation 49 of the movable ramp 35 and whose other portion 36 can be disposed in one of the openings of the articulated movable ramp 35, selected as a function of the size of the selected targets.

This abutment 44 in the form of a hook is disposed below the movable ramp 35, its end 46 serving as an abutment per se passes through the selected opening of the articulated movable ramp 35.

The return of the hook 46 has a height sufficient to be able to leave the passage free for the pivoting of the articulated movable ramp 35.

The fixed holding slideway is maintained by securements 47, 48 such as screws, rivets, axles, etc.

What is claimed is:

1. In an apparatus for launching targets for trap shooting whose speed and distance of projection are variable, of the type using a rotatable drum (1) into which are loaded movable targets (2); the movable targets (2) are superposed on each other in columns (3) and are disposed above and parallel to a fixed base plate which comprises a single recess (5) so as to permit the passage of movable targets (2) which are received on a launching plate (6) disposed before an ejection arm (7) secured to a rotational axle (11), at least one motor ensuring the rotation of the drum (1) and the movement of the ejection arm (7); the improvement wherein the launching plate (6) is comprised by a fixed launching ramp (9) and a movable launching ramp (8) articulated about a pivotal axis (10), said pivotal axis being substantially transverse to said launching ramp, and the upper surfaces of said ramps (9, 8) are at the same height below and parallel to the path of the ejection arm (7).

2. Apparatus according to claim 1, wherein the pivotal axis (10) is directed substantially towards the axle of rotation (11) of the ejection arm (7), such that the movable and articulated launching ramp (8) pivots between two end positions, a position pivoted by an angle ($\alpha$), in which one of the two ends of said movable launching ramp (8) is facing and at the height of the recess (5) provided in the base plate so as to receive at least one target (2) from the rotatable drum (1), said target (2) being adapted to be launched, and a launching position in which the movable launching ramp is at a height below but parallel to the path of the ejection arm (7).

3. Apparatus according to claim 1, wherein the movable and articulated launching ramp (8) has in its lower portion a longitudinal swinging axis (12), said axis (12) being substantially parallel to the tangent to the trajectory of the ejection arm (7) at the level of the movable launching ramp (8) such that said movable and articulated launching ramp (8) swings between two end positions, a launching position in which the movable launching ramp (8)is at a height below and parallel to the trajectory of the ejection arm (7), and a swung position in which the ramp is swung through an angle $\beta$ about the swinging axis (12).

4. Apparatus according to claim 1, wherein the movable launching ramp (8) has, in its downstream portion with respect to the direction of launching of the targets (2) and in its lower portion, a roller (14) which coacts with a cam (13) fixed to the ejection arm (7), and in its upstream portion relative to the direction of launching the targets (2), a spring (16); such that when the roller (14) is in contact with the portion of the cam (13) farthest from the pivotal axis (10), the spring (16) brings said movable ramp (8)into pivoted position, while when the roller (14) is in contact with the portion of the cam (13) closest to the pivotal axis (10), said cam (13) causes the movable ramp (8) to pivot about the pivotal axis (10) and brings it into launching position.

5. Apparatus according to claim 1, wherein the movable and articulated launching ramp (8) has, in its upstream portion, different holes (21) which permit the securement of at least one abutment (18) adjustably as to position.

6. Apparatus according to claim 1, wherein the launching plate (6) has a holding finger (15) in an initial position for the targets (2), said holding finger being movable in rotation relative to an axis to permit returning said holding finger to said initial position via a spring.

7. Apparatus according to claim 1, further comprising a guide slideway (17) adjustable as to arc and radius relative to the axle of rotation (11) of the ejection arm (7) disposed laterally of the outer side of the movable launching ramp (8).

8. Apparatus according to claim 7, wherein the adjustable guide slideway (17) is arcuate.

9. Apparatus according to claim 7, wherein the guide slideway is formed of two slideways, a fixed slideway (36) and an articulated slideway (37).

10. Apparatus according to claim 9, wherein the fixed slideway (36) is parallel to the plane of the launching plate (34) and the articulated slideway (37) remains parallel to the plane of the movable launching ramp.

11. Apparatus according to claim 10, wherein the articulated slideway (37) prolongs the fixed slideway (36) but is articulated about a pivoting axis (38), its end in contact with the movable articulated launching ramp (35) ensuring simultaneous movement with said ramp.

12. Apparatus according to claim 9, wherein the contact of the articulated slideway (37) and of the movable articulated ramp (35) is ensured by holding fingers (39, 40) disposed on opposite sides of each surface of said ramp.

13. Apparatus according to claim 9, wherein the movable articulated ramp (35) is provided with several openings (41, 42, 43) at its periphery which permit the emplacement of an abutment (44) for the targets (32); said abutment (44)is a recurved member such as a hook whose one part (45) is fixed to the frame of the apparatus and whose other part (46) can be disposed in the openings of the movable articulated ramp selected as a function of the sizes of the chosen targets.

14. Apparatus according to claim 13, wherein said abutment (44) in the form of a hook is disposed below the movable ramp (35), its end (46) serving itself as an abutment passing through the selected opening of the articulated movable ramp (35); the return of the hook (46) has a height sufficient to be able to leave free the passage for the pivoting of the articulated movable ramp (35).

* * * * *